US005522549A

United States Patent [19]

Sheu

[11] Patent Number: 5,522,549

[45] Date of Patent: Jun. 4, 1996

[54] JET NOZZLE ASSEMBLY FOR REMOVING PESTS FROM CROPS

[76] Inventor: Kun N. Sheu, No. 36, Chuang Wei I Lane, Erh Shui Tsun, Erh Shui Hsiang, Chang Hua Hsien, Taiwan

[21] Appl. No.: 328,011

[22] Filed: Oct. 24, 1994

[51] Int. Cl.[6] ..... B05B 1/34

[52] U.S. Cl. ..... 239/492; 239/499; 239/590.5; 239/600

[58] Field of Search ..... 239/590.5, 492, 239/493, 499, 600

[56] References Cited

U.S. PATENT DOCUMENTS 4,161,290 7/1979 Hill ..... 239/499
4,187,986 2/1980 Petrovic ..... 239/492
4,715,537 12/1987 Calder ..... 239/600
5,067,655 11/1991 Farago et al. ..... 239/493

*Primary Examiner*—Andres Kashnikow
*Assistant Examiner*—Lisa Ann Douglas
*Attorney, Agent, or Firm*—Browdy and Neimark

[57] ABSTRACT

A jet nozzle assembly including a socket to hold a nozzle plate having a jet nozzle, a stepped barrel fastened to the socket to hold a hollow shaft having a front cup, a coupling coupled to a water supply pipe, a connector connected between the hollow shaft and the coupling to guide water from the water supply pipe through a water passage on the hollow shaft, permitting water to be further driven out of the jet nozzle of the nozzle plate through spiral grooves on the front cup of the hollow shaft.

1 Claim, 4 Drawing Sheets

JET NOZZLE ASSEMBLY FOR REMOVING PESTS FROM CROPS

BACKGROUND OF THE INVENTION

The present invention relates to nozzles, and relates more particularly to a jet nozzle assembly used to produce a jet of water for removing pests from crops.

While cultivating crops, farmers will regularly spray pesticide to kill pests. However, using pesticide to kill animal pests will cause environmental pollutions or contamination problems. Before eating or cooking, fruits and vegetables must be thoroughly washed to remove residual pesticide. However, because crops may absorb residual pesticide from soil, washing crops before eating or cooking cannot completely eliminate the problem of pesticide contamination.

SUMMARY OF THE INVENTION

The present invention has been accomplished under the circumstances in view. It is therefore the main object of the present invention to provide a jet nozzle assembly which can be used with a 3½ horsepower water pump to produce a jet of water for removing pests from living crops so as to eliminate the application of pesticide in killing pests. To achieve this object, there is provided a jet nozzle assembly comprised of a socket to hold a nozzle plate having a jet nozzle, a stepped barrel fastened to the socket to hold a hollow shaft having a front cup, a coupling coupled to a water supply pipe, a connector connected between the hollow shaft and the coupling to guide water from the water supply pipe through a water passage on the hollow shaft, permitting water to be further driven out of the jet nozzle of the nozzle plate through spiral grooves on the front cup of the hollow shaft.

DETAILED DESCRIPTION OF THE PREFERRED EMBODIMENT

Figure 1:
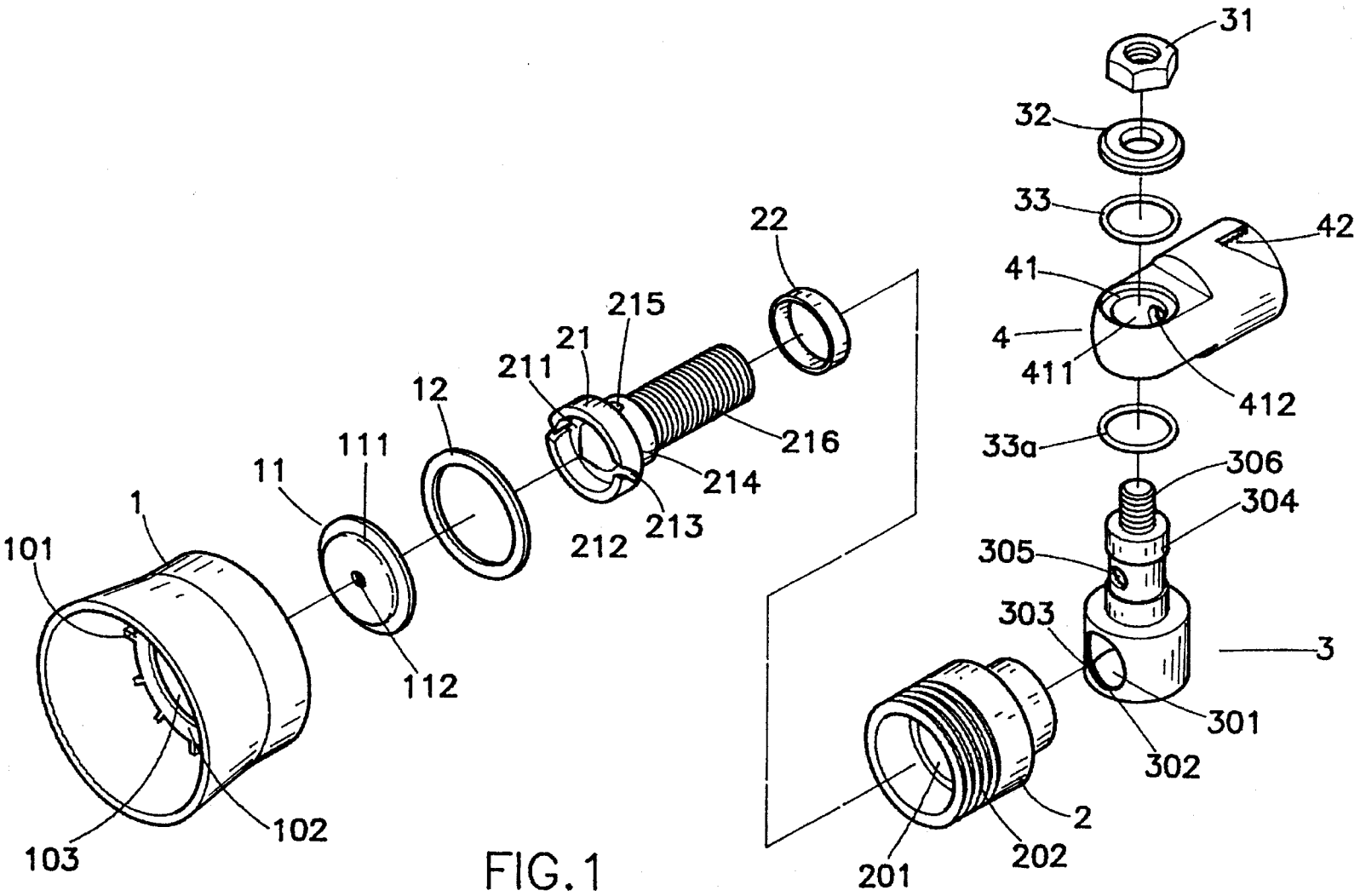
FIG. 1 is an exploded view of a jet nozzle assembly according to the present invention.

Referring to FIG. 1, a jet nozzle assembly in accordance with the present invention is generally comprised of a socket 1, a stepped barrel 2, a connector 3, and a coupling 4. The socket 1 is covered with a nozzle plate 11 and sealed by a packing ring 12, having a plurality of inside ribs 101 and a ring plate 102 retained within the inside ribs 101. The socket 1 further comprises a screw hole 103 at one end, which receives the nozzle plate 11 and the packing ring 12 on the inside. The nozzle plate 11 has a circular flange 111 at an inner side and a jet nozzle 112 at the center. The stepped barrel 2 holds a hollow shaft 21 and a rubber ring 22, defining a longitudinal open chamber 201 and having an outer thread. The shaft 21 comprises a front cup 211 at one end, two opposite spiral grooves 213 on the peripheral wall of the front cup 211, a conical member 212 received in the front cup 211, a hollow screw rod 216 at an opposite end, an intermediate shaft section 214 connected between the front cup 211 and the hollow screw rod 216, two opposite water outlets 215 through the intermediate shaft section 214 at two opposite locations, and a longitudinal water passage 217 through the hollow screw rod 216 in communication with the water outlets 215. The connector 3 comprises a water chamber 301, a water outlet 302 at one end of the water chamber 301, an inner thread 303 around the water outlet 302, a stepped mounting stem 304 above the water chamber 301, two opposite water inlets 305 on the stepped mounting stem 304 at two opposite sides in communication with the water chamber 301, an outer thread 306 around the top end of the stepped mounting stem 304 for mounting a locknut 31 and a gasket 32 and a pair of rubber rings 33 and 33a. The coupling 4 comprises a front mounting hole 411 vertically disposed at one end, two annular grooves 41 around two opposite ends of the front mounting hole 411, a rear coupling portion 42, and a longitudinal water passage 412 communicated between the rear coupling portion 42 and the front mounting hole 411.

Figure 2:
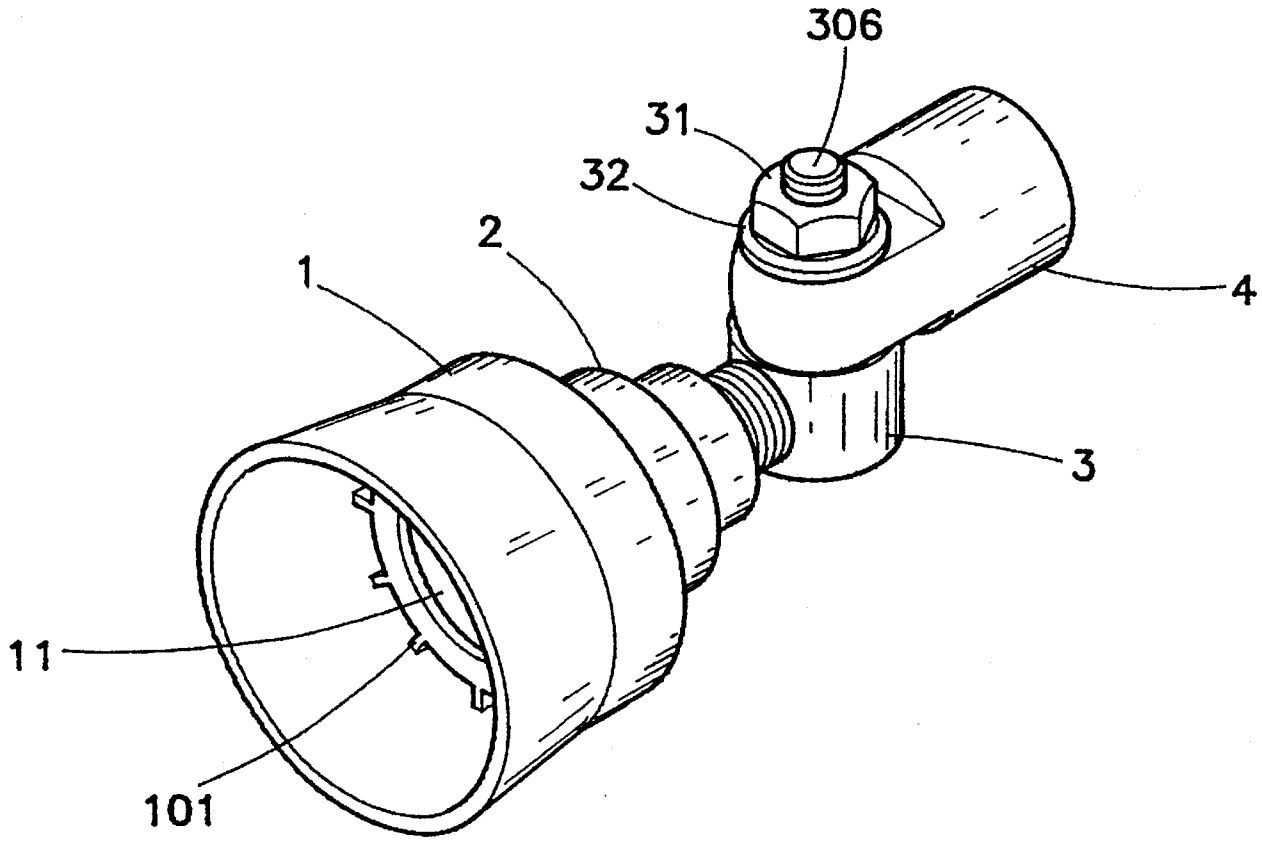
FIG. 2 is an elevational view of the jet nozzle assembly shown in FIG. 1.
Figure 3:
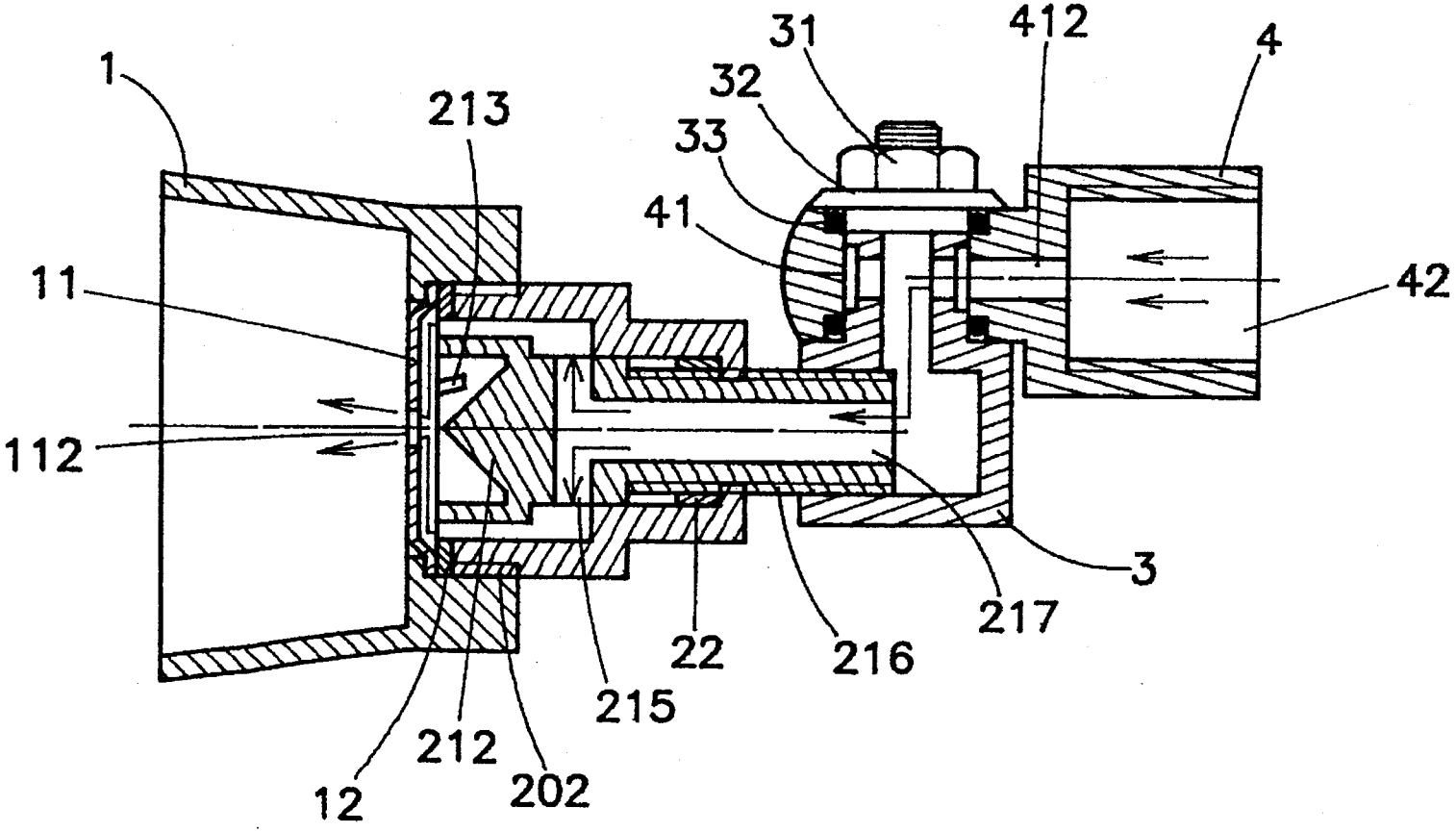
FIG. 3 is sectional view of the jet nozzle assembly of FIG. 2.

The assembly process of the jet nozzle assembly is outlined hereinafter with reference to FIGS. 1, 2, and 3. The outer thread 306 of the stepped mounting stem 304 is inserted from the bottom in proper order through the rubber ring 33*a*, the rubber ring 33, and the gasket 32, and then screwed up with the locknut 31, permitting the rubber rings 33*a* and 33 to be firmly respectively retained with the annular grooves 41. After the connection of the connector 3 and the coupling 4, the rubber ring 22 is mounted around the screw rod 216 of the shaft 21, then the screw rod 216 of the shaft 21 is inserted through longitudinal open chamber 201 of barrel 2 and threaded into the inner thread 303 of the connector 3 and then welded to the connector 3 by spot welding. When the shaft 21 and the stepped barrel 2 are connected to the connector 3, a gap is left between the outside surface of the front cup 211 and the peripheral wall of the longitudinal open chamber 201. The nozzle plate 11 and the packing ring 12 are then fastened to the socket 1 by threading the outer thread 202 of the stepped barrel 2 into the screw hole 103, permitting the circular flange 111 to fit into the ring plate 102.

Figure 4:
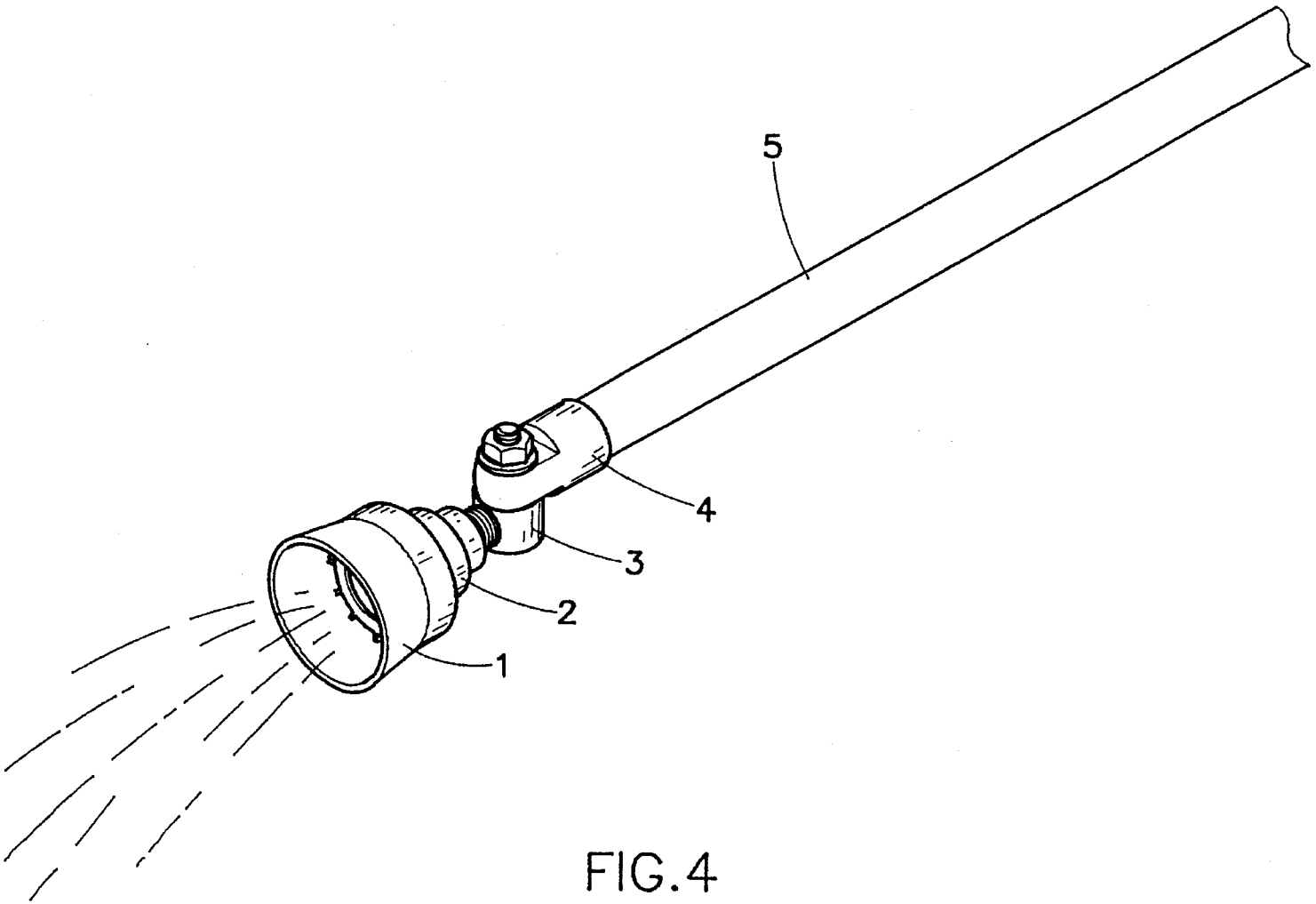
FIG. 4 shows the jet nozzle assembly of FIG. 2 operate.

Referring to FIG. 4, when the rear coupling portion 42 of the coupling 4 is coupled to a water supply pipe 5, water from the water supply pipe 5 flows through the water passage 412 and front mounting hole 411 of the coupling 4 into the water chamber 301 of the connector 3 via the water inlets 305, and then flows out of the water chamber 301 through the water outlet 302 into the water passage 217 of the shaft 21, and then flows out of the water outlets 215 on the intermediate shaft section 214 of the shaft 21 and is then guided by the spiral grooves 213 and the conical member 212 to move out of the jet nozzle 112 rapidly. When the jet nozzle assembly is used to eject a jet of water against crops, the pressure of the ejection of water does not damage the tissues of crops when pests are removed.

It will be understood that various modifications and changes could be made without departing from the spirit and scope of the invention.

What is claimed is:

1. A jet nozzle assembly comprising:

a coupling having a front mounting hole vertically disposed at one end, two annular grooves around two opposite ends of said front mounting hole, a rear coupling portion coupled to a water supply pipe, and a longitudinal water passage for guiding water from said water supply pipe to said front mounting hole;

a connector having a water chamber, a stepped mounting stem fastened to said front mounting hole of said coupling by a locknut and a gasket ring and two water sealing rings, permitting said water sealing ring to be mounted around said stepped mounting stem and retained within said annular grooves, said stepped mounting stem having at least one water inlet for guiding water from said vertical mounting hole into said water chamber, said water chamber having a water outlet and an outer thread around said water outlet;

a socket covered with a nozzle plate and sealed by a packing ring, said socket having a ring plate on the inside stopped against said nozzle plate and a screw hole at one end, which receives said nozzle plate sand said packing ring, said nozzle plate having an annular flange at one side fitted into said ring plate and a jet nozzle at the center;

a stepped barrel defining a longitudinal open chamber and having an outer thread at one end threaded into the screw hole on said socket to hold down said nozzle plate and said packing ring; and a shaft having a front cup at one end received within said longitudinal open chamber of said stepped barrel, two opposite spiral grooves on said front cup at two opposite sides, a conical member disposed inside said front cup, a hollow screw rod at an opposite end fastened to the inner thread of said connector, an intermediate shaft section connected between said front cup and said hollow screw rod, two opposite water outlets through said intermediate shaft section at two opposite locations, and a longitudinal water passage through said hollow screw rod for guiding water from the water outlet of said water chamber of said connector into said front cup through said spiral grooves via the water outlets of said intermediate shaft section, permitting water to be further guided by said conical member out of said nozzle plate and said socket through said jet nozzle.

* * * * *